United States Patent [19]

Yanagihara

[11] Patent Number: 4,660,393

[45] Date of Patent: Apr. 28, 1987

[54] WASHING MACHINE

[75] Inventor: Masanobu Yanagihara, Gifu, Japan

[73] Assignee: Kabushika Kaisha Toshiba, Tokyo, Japan

[21] Appl. No.: 775,327

[22] Filed: Sep. 12, 1985

[30] Foreign Application Priority Data

Sep. 28, 1984 [JP] Japan ..... 59-204215

[51] Int. Cl.[4] ..... D06F 39/08

[52] U.S. Cl. ..... 68/26; 68/207; 210/171

[58] Field of Search ..... 68/26, 207; 210/171; 134/94, 100

[56] References Cited

U.S. PATENT DOCUMENTS 3,301,022 1/1967 Low ..... 68/207 X
3,381,700 5/1968 Frymark ..... 68/207 X

FOREIGN PATENT DOCUMENTS 139366 12/1978 Japan ..... 68/207
470 1/1979 Japan ..... 68/26
18161 2/1979 Japan ..... 68/207
2155963 10/1985 United Kingdom .

*Primary Examiner*—Philip R. Coe
*Attorney, Agent, or Firm*—Cushman, Darby and Cushman

[57] ABSTRACT

A washing machine capable of being provided with a water filter device which includes a water inlet port, water outlet port and overflow port. The washing machine includes an operation control console provided with a water intake port and auxiliary intake port at its rear wall in correspondence to the water outlet port and the overflow port of the water filter device respectively, which supports the water filter device. The operation control console is further provided with a water intake opening and access opening at its rear portion, the water intake opening and access opening being respectively covered with a closing member and auxiliary plate when the water filter device is not attached to the control console.

16 Claims, 10 Drawing Figures

WASHING MACHINE

CROSS-REFERENCE TO RELATED APPLICATION

This application is related to copending and commonly owned U.S. patent application Ser. No. 759,343 filed July 26, 1985 in the name of Masahiro Teranishi, the entire disclosure thereof being expressly incorporated hereinto by reference.

BACKGROUND AND SUMMARY OF THE INVENTION

The present invention relates to washing machines, and in particular, to washing machines having an operation control console which is adapted to accommodate an external filter device for filtering foreign substances (e.g. iron oxides) which may be contained in water supplied to the washing machine.

Washing machines having separate washing and dehydrating tubs for respective washing of fabric articles on the one hand and for rinsing and dehydrating the fabric articles on the other hand are well known. When using washing machines of this type in geographical areas where the water supply is contaminated or contains impurities, the washed articles may become discolored by iron oxide powder or other foreign matter contained in the water supply when the contaminated water is suppled to the dehydrating tub for rinsing the washed fabric articles. Therefore, washing machines intended for use in those geographic areas where the water supply is impure must be provided with a filter for filtering the water supplied to the washing and dehydrating tubs. Normally, water filters are provided structurally independently of the washing machine to accomplish such functions. However, such conventional filter devices are more troublesome to the user since the filter device must be manually coupled to the washing machine via hoses or other like conduit means.

To solve the above-mentioned disadvantages, it has recently been proposed to provide a washing machine having an operation control console which internally includes a filter device at its rear portion. Such a washing machine solves the disadvantages with respect to washing machines having structurally independent filter devices but is less than desirable since different operation console shapes must be provided for each different type and/or style of washing machine. The requirement for producing and maintaining a stock inventory for a variety of machine consoles of course leads to increased costs.

A principal object of the present invention therefore is to provide a washing machine which is adapted to have a filter device mounted on the operation console thereof and, moreover, which has a universal construction whether or not the console is provided with such a filter device so as to reduce production costs.

BRIEF DESCRIPTION OF THE ACCOMPANYING DRAWINGS

The present invention will be better understood by reference to the accompanying drawings, wherein like reference numerals throughout the various Figures denote like structural elements and wherein.

DETAILED DESCRIPTION OF THE PREFERRED EXEMPLARY EMBODIMENTS

Preferred embodiments of the present invention will now be described in more detail with reference to the accompanying drawings.

Figure 1:
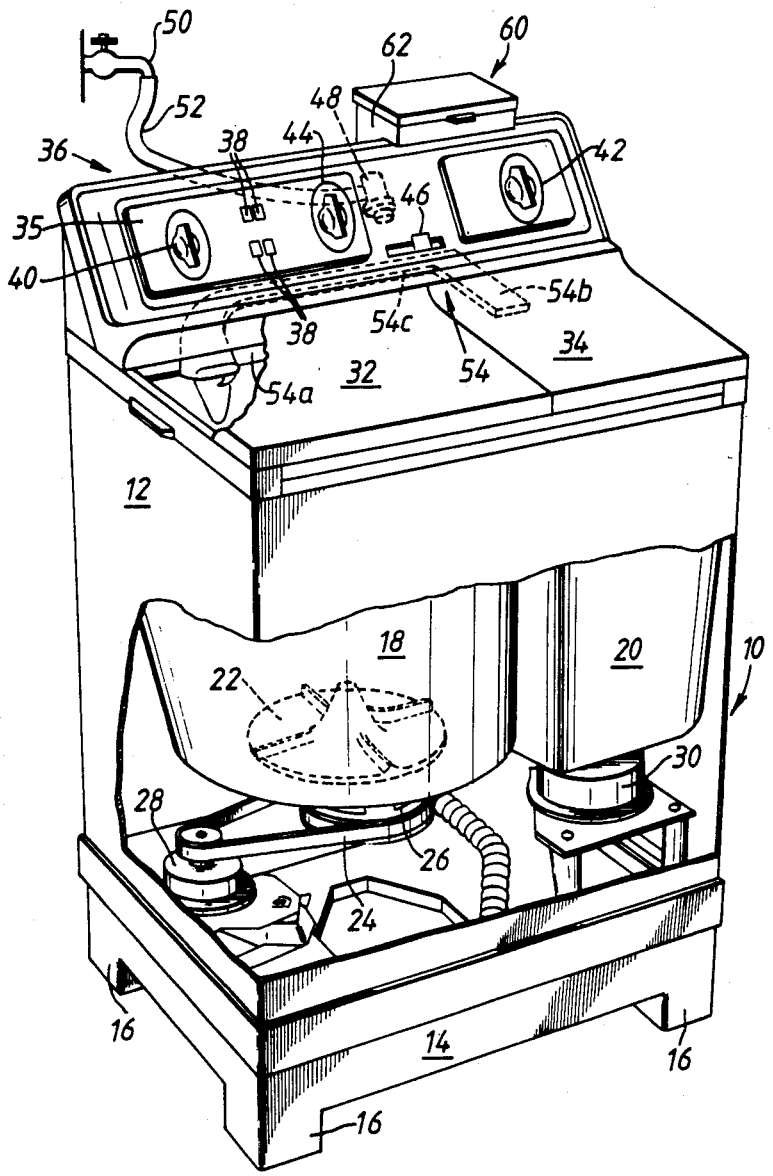
FIG. 1 is a perspective view, partly in section, of a washing machine of this invention.

An overall assembly of a washing machine 10 of the present invention is shown in accompanying FIG. 1. An outer cabinet 12 of the washing machine is mounted on a pedestal 14 having four individual legs 16 at each corner thereof. The outer cabinet 12 houses a washing tub 18 and a separate dehydrating tub 20 in which a spin tub (not shown) is rotatably supported. An agitator 22 is rotatably mounted on the bottom of the washing tub 18 and is driven through belt 24 and pully 26 by means of a motor 28 mounted on the pedestal 14. The spin tub (not shown) is similarly rotated by means of motor 30 which is also mounted on the pedestal 14.

The washing tub 18 and dehydrating tub 20 are covered with respective lids 32, 34 which are detachably mounted to the outer cabinet 12. An operation control console 36 upwardly extends from the top of the cabinet 12 at the rear portion of the washing machine 10. As is conventional, the front surface 35 of console 36 includes manually-operable operating buttons 38, a wash timer 40, a spin timer 42 and a water level selection knob 44. A water supply change-over lever 46 is also provided on the slanted front surface 35 of the console 36. A water supply control device 48 (shown in broken line in FIG. 1) is housed in the console 36 and is connected to the water supply tap 50 through a hose 52 or like conduit means. The water supply control device 48 is preferably a conventional water controller which regulates the water flow rate by means of a valving device (not shown) housed therein.

A water duct 54 is provided within cabinet 12 such that one end **54*a* thereof opens into the washing tub 18 while the other end 54*b* thereof opens into the dehydrating tub 20. A partition wall 54*c* adjacent to the water supply change-over lever 46 is provided in the duct 54 so as to partition the duct 54 into separate supply paths to the tubs 18 and 20**.

Figure 2:
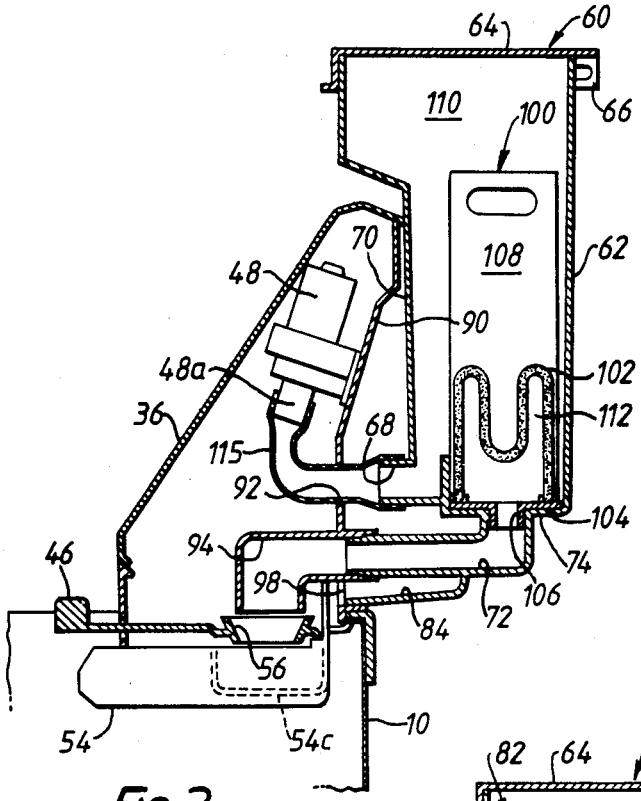
FIGS. 2 and 3 are vertical side sectional views of a filter device particularly well suited for use with the washing machine of FIG. 1 and being shown coupled to a control console thereof.
Figure 3:
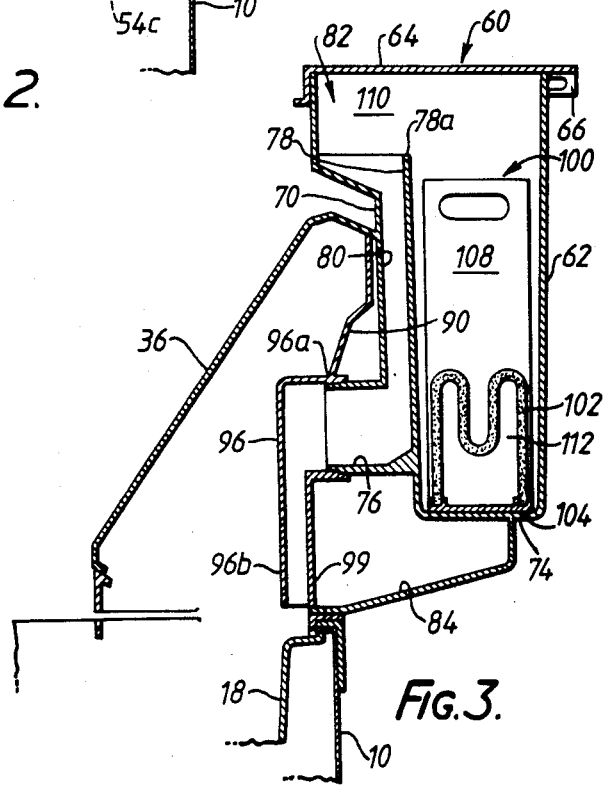

As is more clearly seen in FIGS. 2 and 3, the water supply change-over lever 46 is provided with guide tube 56, which is preferably downwardly tapered. The water supply change-over lever 46 is moved toward the washing tub 18 (i.e. towards the left as viewed in FIG. 1) or towards the dehydrating tub 20 (i.e. towards the right as viewed in FIG. 1), the bottom end of the water guide tube 56 is thereby responsively positioned on the left or right sides, respectively, of the partition wall 54*c*. Thus, the direction in which the supply water is fed via duct 54 is selectively changed either to the washing tub 18 or the dehydrating tub 20. A filter device 60 is fixed to the rear of the operation control console 36 by means of screws or other like securing elements.

Figure 4:
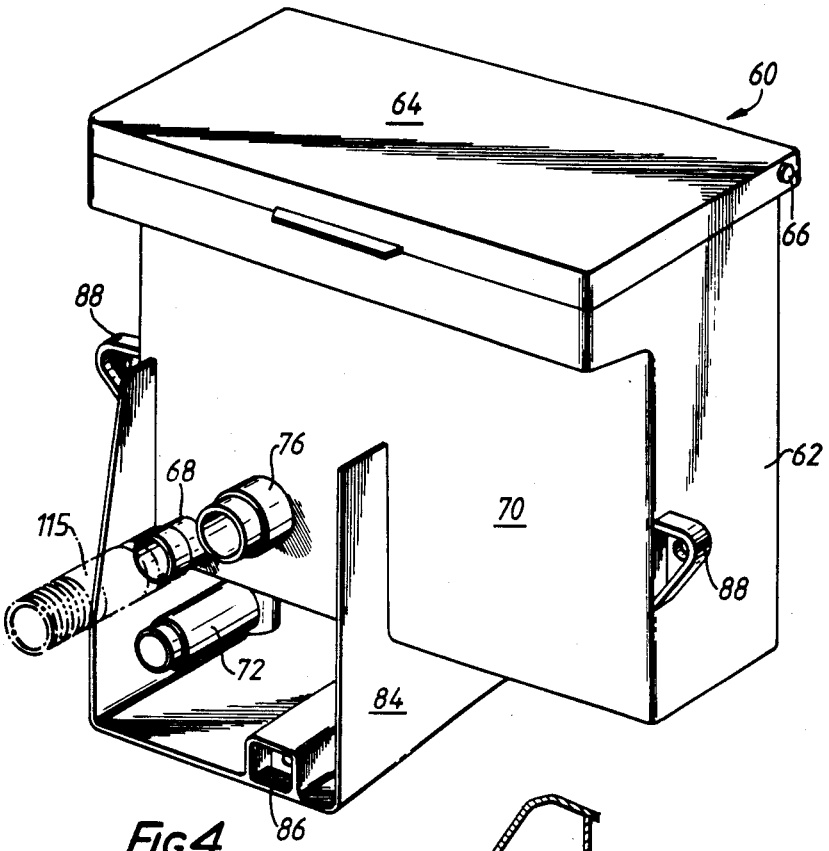
FIG. 4 is a perspective view of the filter device of FIGS. 2 and 3.

A container 62 of the filter device 60 is opened at its upper end and includes a lid member 64 pivotally mounted to the upper end of container 62 by means of hinge assembly 66. The lid member 64 is thus capable of opening and closing the upper open end of container 62. A tubular water inlet port 68 is integrally formed at the front wall 70 of the container 62, such that it forwardly projects from the front wall 70 as shown more clearly in FIG. 4. A water outlet port 72 is also integrally formed in the bottom wall 74 of the container 62, such that it projects forwardly from the front wall 70 of the container 62. The water outlet port 72 preferably forwardly extends parallel to the water inlet port 68. A tubular overflow port 76 forwardly projects from the front wall 70 of the container 62 and also preferably forwardly extends parallel to the water inlet port 68 and the water outlet port 72.

The overflow port 76 includes a partition wall 78 disposed substantially parallel to the front wall 70 of the container 62 and upwardly projects from the bottom wall 74 of the container 62 (see FIG. 3). The partition wall 78 and the front wall 70 of the container 62 together define an overflow passage 80 formed so as to extend vertically within the front part of the container 47 such that the upper part of the overflow passage 80 is in fluid communication with and opens upwardly within the upper interior portion 82 of the container 62.

A U-shaped water receiving wall 84 is provided near the bottom wall 74 of the container 62. The water receiving wall 84 surrounds the water inlet port 68, the water outlet port 72 and the overflow port 76 and projects from the front wall of the container 62 such that it is formed as a forwardly and downwardly inclined spout. A screw holding portion 86 is formed at the front end of the water receiving wall 84 while a lateral pair of screw holding portions 88 project from the both sides of the container 62 adjacent front wall 70. As is shown in FIGS. 2 and 3, a rear portion 90 of the console 36 which faces the water inlet port 68, the water outlet port 72 and the overflow port 76 of the container 62, is concaved inwardly so as to permit connection of the filter device 60 to the console 36 as will be described in greater detail below.

A water intake opening 92 is formed on the rear portion 90 of the operation control console 36 in correspondence to the water inlet port 68 of the container 62. A tubular intake port 94, (one end of which rearwardly projects) is also formed at the rear portion 90 of the operation control console 36 in correspondence to the water outlet port 72 of the container 62. The other end of the tubular intake port 94 extends into the operation control console 36 and is downwardly bent so that it is capable of being registered with the water guide tube 56 when the latter is moved therebeneath upon manipulation of lever 46. The intake port 94 thus selectively communicates with either the washing tub 18 or the dehydrating tub 20, through manipulation of the water guide tube 56 via lever 46.

A tubular auxiliary intake port 96 is formed at the rear portion 90 of the operation control console 36 in correspondence to the overflow port 76 of the container 62 as is more clearly seen by reference to FIG. 3. One end 96*a* of the auxiliary intake port 96 projects rearwardly while the other end 96*b* extends into the operation control console 36 and is bent downwardly so that it opens into the dehydrating tub 20. Water intake holes 98, 99 are provided at the lower part of rear portion 90 so as to direct any water which may leak from the couplings of ports 68, 72 and 76 via the water receiving wall 84 of the container 62 and into the washing tub 18.

A filter assembly 100 is removably housed within the container 62 as shown in FIGS. 2 and 3. The filter assembly 100 includes a filter medium 102 which is corrugated in form as is described in greater detail in copending U.S. patent application Ser. No. 759,343 filed July 26, 1985 in the name of Masahiro Teranishi. As is conventional, the filter medium 102 is formed of porous material having a dense plurality of fine water-permeable holes.

The filter medium 102 is supported in the container 62 by means of a base plate 104 extending along the elongated direction of the filter medium 102 and which defines a tubular discharge port 106 projecting downwardly from the bottom thereof. A pair of side wall plates 108 are mounted upright on respective sides of the base plate 104 by means of respective integral hinges (not shown).

The filter medium 102 is attached to the base plate 104 and side wall plates 108 by securing one to the other utilizing e.g. adhesive so that they together close the otherwise open bottom and sides of the filter medium 102. When the filter medium 102 is properly positioned within container 62, an intake chamber 110 and discharge chamber 112 is established therein. At the same time, the discharge port 106 is inserted into and thus in fluid communication with the wáter outlet port 72 the container 62.

Figure 6:
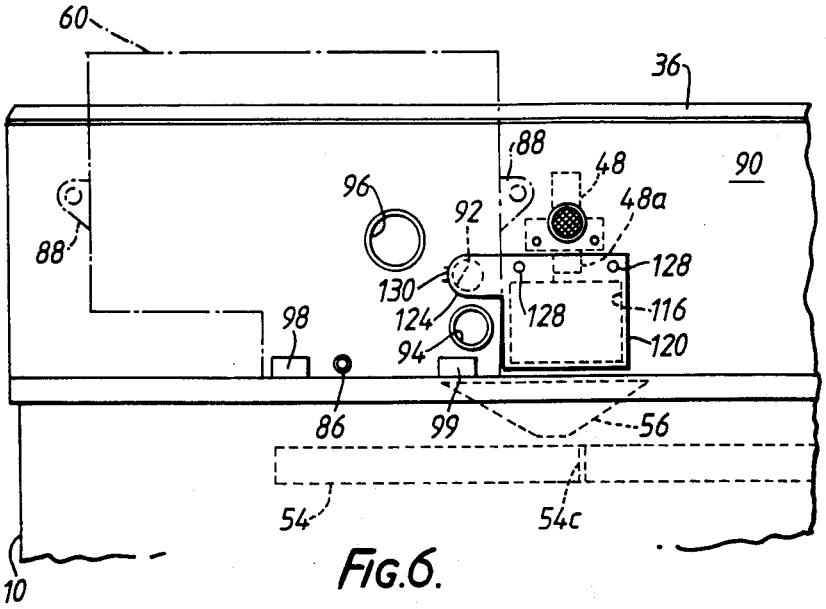
FIG. 6 is a rear view of the operation control console of FIG. 5.

The cont is thus adapted to be mounted on the rear portion 90 of the operation control console 36 by means of screws threadably coupled through the screw holding portions 86 and 88 of the container 62 as is shown in double-dashed chain line in FIG. 6. While in this mounted configuration, the water outlet port 72 of the container 62 is inserted into the intake port 94 of the control console 36, while the overflow port 76 is inserted into the auxiliary intake port 96 as can be seen more clearly in FIGS. 2 and 3. The water receiving wall 84 of the container 60 communicates with the washing tub 18 through the intake holes 98, 99.

The water inlet port 68 of the container 62 and a connection port 48*a* of the water supply control device 48 are connected to one another by means of hose 115. One end of a hose 115 is fitted onto the water inlet port 68 prior to the mounting of container 62 upon console 36. The other end of the hose 115 is introduced into the operation control console 36 through the water intake opening 92 and fitted onto the connection port 48*a* of control device 48 thereby establishing fluid communication between the water inlet port 68 and the water supply control device 48. During the connection operation, access opening 116 defined on the rear wall 90 of the operation control console 36 (as shown in dotted line in FIG. 6) enables an operator to easily connect the hose 115 to the connection port 48*a* of the water supply control device 48.

Figure 7:
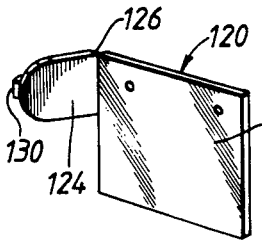
FIG. 7 is a perspective view of a closing member employed with the first embodiment of the present invention.

The access opening 116 is closed by a closing member 120 as is shown in FIG. 6. The closing member 120 includes a main plate portion 122 and an auxiliary plate portion 124. The auxiliary plate portion 124 is formed on one side of the main plate portion 122 and is integrally connected thereto by means of an integral hinge 126 as is shown in FIG. 7 so that the access opening 116 can be covered with the closing member 120 which is attached to the back of the operation control console 36 by means of screws 128. The auxiliary plate portion 124 also includes a pawl 130 projecting therefrom at a right angles at a side opposite to the integral-hinged 126.

When washing or rinsing operations are performed, the water change over lever 46 is positioned according to the desired operation and the water supply tap 50 is turned on. When either the washing timer knob 40 or the spin timer knob 44 is operated, the water supply control device, 48 is automatically opened as is conventional. Water is then fed from the water supply and flows into the intake chamber 110 of the container 62 through the water inlet port 68. The water in chamber 110 then flows through filter medium 102 thereby filtering out impurities and enters discharge chamber 112 whereupon the filtered water flows through discharge port 106 and then on to the appropriate tub 18 or 20 depending upon the position of the water guide tube 56.

During extend periods of usage, the filter medium 102 may become so blocked that it will need cleaning. The level of the water accumulated in the container 62 will be raised above the edge 78*a* of the partition wall 59 since the top edge 78*a* establishes a maximum water level within the container 62. The excess water will therefore flow into the overflow passage 80, and then out from the overflow port 76 into the dehydrating tub 20 through the auxiliary intake port 96 thereby preventing overflow of water from the container 62 to the exterior environment.

Figure 5:
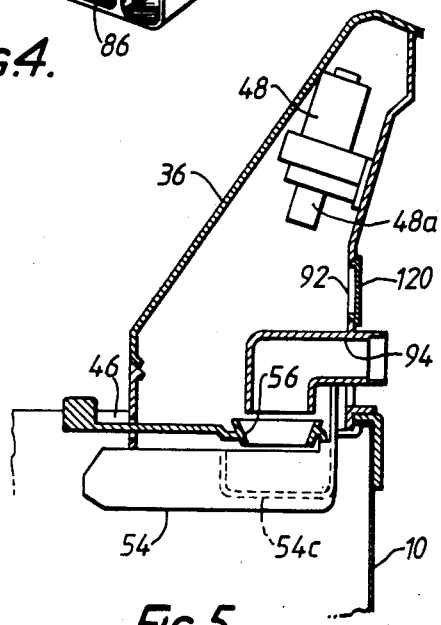
FIG. 5 is a vertical sectional view of an operation control console of the washing machine in accordance with a first embodiment of the present invention.

When the washing machine is not provided with a water filtering device 60, the access opening 116 formed on the back of the operation control console 36 is closed by screwing the main plate portion 122 of the closing member 120 to the rear portion 90 as can be seen by reference to FIGS. 5 and 6. Further, the water intake opening 92 is also closed by auxiliary plate portion 124 of the closing member 120 in such manner that the pawl 130 of the auxiliary plate portion 124 is engaged with the edge defining the water intake opening 92 at the rear of console 36. Thus, the auxiliary plate portion 124 can be pivotally moved due to its integral hinge 126 so as to expose intake opening 92 and thus permit attachment of filter device 60. On the other hand, if filter device 60 is not provided, auxiliary plate portion 124 can be pivoted so that pawl 130 engages the edge of opening 92 thereby closing the latter. As is specifically shown in FIG. 6, the connection port 48*a* of the water control device 48 is in registry with the water guide tube 56 so that water which flows from the connection port 48*a* is directly supplied to either tubs 18 or 20 through the water guide tube 56 when filter device 60 is not present.

According to the above-described embodiment, the construction of the control console 36 of the washing machine is universal for those machine models provided with or lacking a filter device 60. In addition, it is relatively easy to attach the filter device 60 to the washing machine in such manner that the water outlet port 72 and overflow port 76 of the container 62 are individually inserted into the intake port 94 and auxiliary intake port 96, respectively, of the operation control console 36 when the container 62 is fitted to the rear of the control console 36. Moreover, installation of the filter device 60 is more efficient owing to the structures of the control console 36 particularly during coupling of the connection port 48*a* of water control device 48 and the water inlet port 68 of the container 62 with the hose 115 through water intake opening 92.

Figure 8:
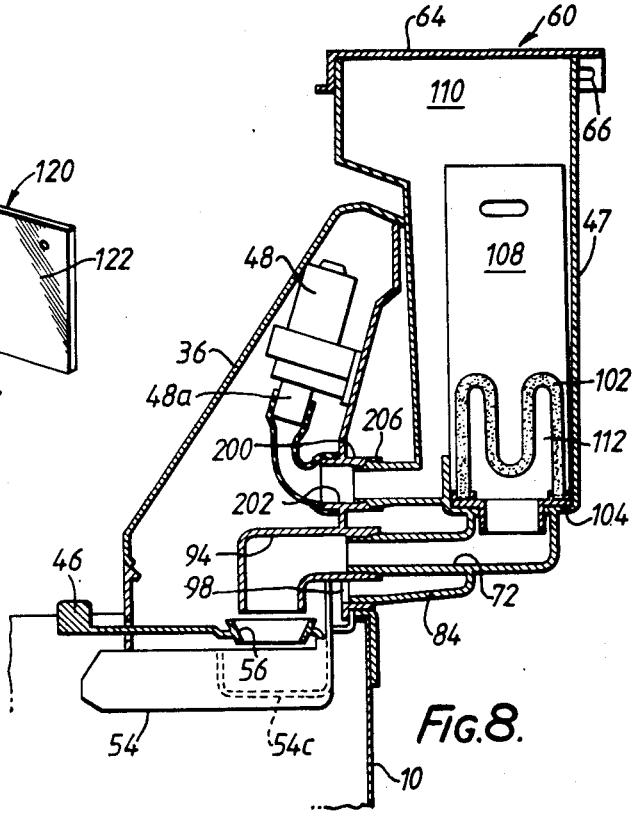
FIG. 8 is a vertical side sectional view of a filter device which is somewhat similar to the filter device of FIG. 2 and is shown coupled to the washing machine console.
Figure 9:
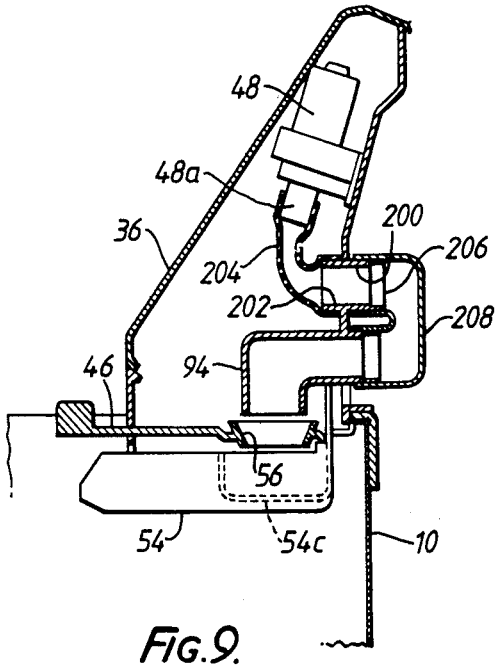
FIG. 9 is a vertical side sectional view of an operation control console of the washing machine in accordance with another embodiment of the present invention.
Figure 10:
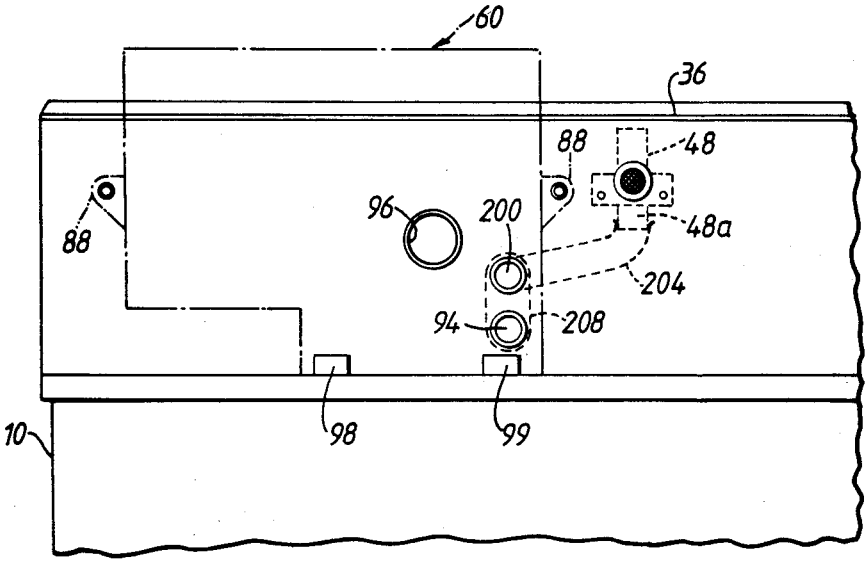
FIG. 10 is a rear view of the operation control console of FIG. 9 in which a pipe joint member is removed from the construction.

FIGS. 8–10 show another embodiment of the present invention wherein a connection pipe 200 is formed on the back of the control console 36 rather than the water intake opening 92 discussed above with respect to the embodiment of this invention shown in e.g. FIGS. 2 and 3. The connection pipe 200 extends from the rear wall 90 of control console 36 both outwardly and inwardly. As is shown in FIG. 8, since the intake port 48*a* is coupled to the interior end 202 of pipe 200 by means of hose 204 during assembly of console 36, filter device 60 can be readily mounted to console 36 merely by inserting water inlet port 68 into the exterior end 206 of pipe 200 so as to establish fluid communication between control device 48 and intake chamber 110.

When the washing machine 10 is constructed without a water filter device 60 (as is shown in FIG. 9) the exterior end 206 of the connection pipe 200 and the water intake port 94 are communicated to one another through a U-shaped pipe joint member 208, the ends of which are mounted onto the outer surface of the water intake port 94 and the exterior end 206 of the connection pipe 200 respectively. The water intake opening 92 of the control console 36 used in the embodiment described above with reference to FIGS. 2–3 is therefore eliminated, and thus the mounting of the filter device 60 to the washing machine 10 is rendered more easy in comparison therewith.

In summary, it will be seen that the present invention overcomes the disadvantages of the prior art and provides an improved construction for an operation control console of a washing machine which can be fitted with a water filtering device. Many changes and modifications in the above-described embodiments can thus be carried out without departing from the scope of the present invention. Therefore, the appended claims should be construed to include all such modifications.

What is claimed is:

1. A washing machine to which a water filter device of the type including a water inlet port, a water outlet port and overflow port is adapted to be mounted, said washing machine comprising:

outer cabinet means for supporting a washing tub to retain items to be washed and a dehydrating tub to rinse and dehydrate the washed items;

operation control console means for supporting the water filter device when the water filter device is attached thereto;

water supply control means for controlling a flow rate of water into the washing machine from a water supply;

means establishing a water intake opening for permitting said water supply control means to be connected to the water inlet port of the water filter device when the filter device is attached to said operation control console;

means defining an access opening for providing access to said water supply control means and thus permit said water supply control means to be operatively connected to the water inlet port of the filter device;

intake port means for conducting filtered water from the water outlet port of the water filter device into said operation control console means when the water filter device is attached to said operation control console; and auxiliary intake port means for conducting water which overflows from the overflow port of the water filter device when the water filter device is attached to said operation control console.

2. The washing machine according to claim 1 further including closure means for closing said access opening.

3. The washing machine according to claim 2, wherein said closure means includes an auxiliary plate to cover said water intake opening means when the water filter device is not attached to said operation control console means.

4. The washing machine according to claim 3 wherein said closure means also includes a main plate portion for closing said access opening and hinge means integrally connecting said auxiliary and main plates to permit said auxiliary plate to be pivoted relative to said main plate.

5. The washing machine according to claim 4 wherein said auxiliary plate includes an engagement pawl for engaging said means establishing said intake opening to removably lock said auxiliary plate in a covering relationship to said intake opening.

6. The washing machine according to claim 2 further including flow control means for selectively directing the flow of water from said water supply control means to only one of said washing tub and said dehydrating tub.

7. The washing machine according to claim 6, wherein said flow control means includes a water duct which establishes separate washing and dehydrating flow paths, said washing flow path being in fluid communication with to the washing tub and said dehydrating flow path being in fluid communication with said dehydrating tub.

8. The washing machine according to claim 7, wherein said water supply means further includes water guide means for selectively directing water which flows from said water supply control means to either said washing flow path or said dehydrating flow path of said water duct.

9. The washing machine according to claim 8 wherein said water supply means further includes lever means for permitting said water guide means to be manually movable between a first position wherein water is guided to said washing flow path and a second position wherein water is guided to said dehydrating flow path.

10. A washing machine capable of being provided with a water filte device of the type including a water inlet port, a water outlet port an overflow port; said washing machine comprising:

outer cabinet means for supporting a washing tub which retains items to be washed and a dehydrating tub which rinses and dehydrates the items;

operation control console means for supporting a water filter device when the water filter device is attached thereto;

water supply control means for controlling a flow rate of water fed from a water supply;

intake pipe means for receiving water from said water supply control means, and for feeding water to the water inlet port of the water filter device when the water filter is attached to said operation control console means, one end of said intake pipe means being connected to said water supply control means;

intake port means for conducting water from said intake pipe means into said operation control console means, said intake port means conducting filtered water from the water outlet port of the water filter device into said operation control console means when the water filter device is attached to said operation control console means;

auxiliary intake port means for conducting water, which overflows the overflow port of the water filter device, into said operation control console means when the water filter device is attached to said operation control console means.

11. The washing machine according to claim 10, further including connection pipe means for establishing fluid communication between said intake pipe means and said intake port means so as to conduct water from said water supply control means to said operation control console means when the water filter device is not attached to said operation control console.

12. A washing machine comprising:

an outer cabinet;

an operation control console mounted on said outer cabinet, said operation control console including a rear wall which defines a water intake opening and an access opening;

a water supply control device provided within said operation control console to control a flow rate of water fed from a water supply;

a water intake port provided on the rear wall of said operation control console, one end of said water intake port projecting from the rear wall of said operation control console and the other end extending into said operation control console;

an auxiliary intake port provided on the rear wall of said operation control console, one end of said auxiliary intake port projecting from the rear wall of said operation control console and the other end extending into said operation control console;

a closing member attached to the rear wall of said operation control console so as to cover the access opening; and an auxiliary plate attached to the rear wall of said operation control console so as to close the water intake opening.

13. The washing machine according to claim 12, wherein said rear wall includes a concave-shaped portion.

14. The washing machine according to claim 13, wherein said concave-shaped portion is provided with said water intake opening, water intake port and auxiliary intake port.

15. The washing machine according to claim 13, wherein said concave-shaped portion defines an intake hole at its lower portion.

16. A washing machine capable of being provided with a water filter device of the type including a water inlet port, a water outlet port and an overflow port, said washing machine comprising:

an outer cabinet;

an operation control console including a rear wall which defines a water intake opening and an access opening;

a water supply control device provided within said operation control console to control a flow rate of water fed from a water supply;

a water intake port formed on the rear wall of said operation control console in correspondence to the water outlet port of the water filter device; and an auxiliary intake port provided on the rear wall of said operation control console in correspondence to the overflow port of the water filter device.

* * * * *